US010260736B2

(12) United States Patent
Bianchi

(10) Patent No.: US 10,260,736 B2
(45) Date of Patent: Apr. 16, 2019

(54) FURNITURE STRUCTURE WITH LIGHT SOURCES

(71) Applicant: Turn Lights S.r.l., Vicenza (IT)

(72) Inventor: Nereo Bianchi, Vicenza (IT)

( * ) Notice: Subject to any disclaimer, the term of this patent is extended or adjusted under 35 U.S.C. 154(b) by 0 days.

(21) Appl. No.: 15/747,194

(22) PCT Filed: Jul. 21, 2016

(86) PCT No.: PCT/IB2016/054338

§ 371 (c)(1),
(2) Date: Jan. 24, 2018

(87) PCT Pub. No.: WO2017/021809

PCT Pub. Date: Feb. 9, 2017

(65) Prior Publication Data

US 2018/0238534 A1 Aug. 23, 2018

(30) Foreign Application Priority Data

Aug. 4, 2015 (IT) ..... UB2015A2858

(51) Int. Cl.

| | |
|---|---|
| ***E04F 13/08*** | (2006.01) |
| ***F21V 15/01*** | (2006.01) |
| ***F21V 17/10*** | (2006.01) |
| ***F21V 5/02*** | (2006.01) |
| ***F21V 33/00*** | (2006.01) |

(Continued)

(52) U.S. Cl.
CPC ..... *F21V 33/006* (2013.01); *E04F 13/0832* (2013.01); *E04F 19/063* (2013.01);
(Continued)

(58) Field of Classification Search
CPC ... E04F 13/068; E04F 13/0832; E04F 19/063; F21V 15/013; F21V 15/015;
(Continued)

(56) References Cited

U.S. PATENT DOCUMENTS 5,430,627 A * 7/1995 Nagano ..... F21V 15/013 362/146
6,050,709 A * 4/2000 Hastings ..... F21V 17/007 362/145

(Continued)

FOREIGN PATENT DOCUMENTS

WO 2011151272 12/2011
WO 2012046622 4/2012

*Primary Examiner* — Tsion Tumebo
(74) *Attorney, Agent, or Firm* — Themis Law

(57) ABSTRACT

A furnishing structure with light sources includes two substantially equal base sections facing each other and held together by a connection section and by a pair of end heads to jointly define a prismatic body and jointly delimit at least one slot for light rays to pass, the light rays being emitted by at least one multiple light source positioned removably inside the space delimited by the base sections facing each other and being reflected by the connection section. Each base section includes a first wing, which is coplanar to a first wall of the prismatic body, a second wing, which is adjacent to the first wing, and a third wing, which is adjacent to the second wing and extends parallel from the third wing of the other base section to delimit the slot when the two base sections are facing each other.

13 Claims, 5 Drawing Sheets

Figure 1:
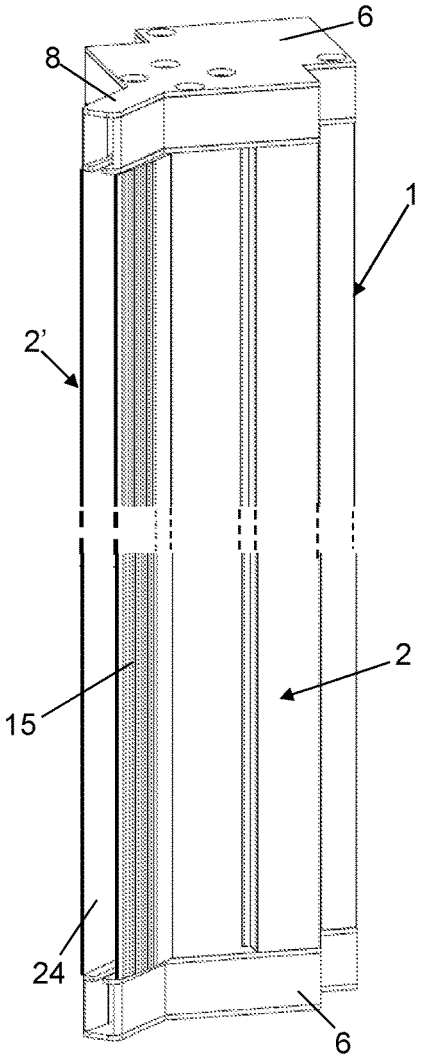

(51) Int. Cl.

| | |
|---|---|
| ***F21V 19/00*** | (2006.01) |
| ***F21V 21/08*** | (2006.01) |
| ***F21V 17/12*** | (2006.01) |
| ***F21V 19/04*** | (2006.01) |
| ***F21V 7/00*** | (2006.01) |
| ***E04F 19/06*** | (2006.01) |
| ***F21V 15/015*** | (2006.01) |
| *E04F 13/06* | (2006.01) |
| *F21Y 103/10* | (2016.01) |
| *F21Y 115/10* | (2016.01) |

(52) U.S. Cl.
CPC ..... *F21V 5/02* (2013.01); *F21V 7/0066* (2013.01); *F21V 15/013* (2013.01); *F21V 15/015* (2013.01); *F21V 17/105* (2013.01); *F21V 17/12* (2013.01); *F21V 19/003* (2013.01); *F21V 19/0045* (2013.01); *F21V 19/045* (2013.01); *E04F 13/068* (2013.01); *F21V 21/0832* (2013.01); *F21Y 2103/10* (2016.08); *F21Y 2115/10* (2016.08)

(58) Field of Classification Search
CPC ..... F21V 17/105; F21V 17/12; F21V 19/003; F21V 19/0045; F21V 19/045; F21V 21/0832; F21V 33/006; F21V 5/02; F21V 7/0066; F21Y 2103/10; F21Y 2115/10
See application file for complete search history.

(56) References Cited

U.S. PATENT DOCUMENTS 6,516,583 B1 * 2/2003 Houghton ..... E04B 1/24 52/167.3
7,237,925 B2 * 7/2007 Mayer ..... F21V 3/04 362/240
8,235,554 B2 * 8/2012 Steinkraus ..... F21V 14/04 362/217.05
8,266,856 B2 * 9/2012 Carlson ..... B29C 47/021 52/309.16
8,562,168 B2 * 10/2013 Napoli ..... F21S 8/026 362/147
8,800,239 B2 * 8/2014 Yang ..... E04B 1/24 403/218
8,998,354 B2 * 4/2015 Wach ..... A47F 3/043 312/138.1
9,004,715 B1 * 4/2015 Litke ..... F21V 21/35 362/217.15
9,188,733 B2 * 11/2015 Hofman ..... E04B 2/7455
9,353,922 B2 * 5/2016 Ferrier ..... F21S 8/026
2002/0007576 A1 * 1/2002 Gai ..... G02B 6/0031 40/546
2002/0056184 A1 * 5/2002 Richardson ..... A47F 3/0434 29/458
2004/0172892 A1 * 9/2004 Cremaschi ..... A47F 3/0434 52/171.3
2005/0180135 A1 8/2005 Mayer
2007/0263379 A1 11/2007 Dowling
2010/0058690 A1 * 3/2010 Rowohlt ..... E04F 19/0436 52/287.1
2011/0285314 A1 * 11/2011 Carney ..... E04B 9/006 315/294
2012/0099300 A1 * 4/2012 Napoli ..... F21S 8/026 362/147
2012/0324771 A1 * 12/2012 Safavi ..... G09F 9/33 40/452
2013/0120974 A1 * 5/2013 Swisha ..... F21V 33/006 362/147
2014/0334136 A1 * 11/2014 Green ..... F21V 33/006 362/147

* cited by examiner

FURNITURE STRUCTURE WITH LIGHT SOURCES

The present invention relates to a furnishing structure with light sources.

Furnishing structures which can generally be used in dwellings, shops and display areas are known. They may be associated with light sources, which depending on their features, may create special plays of light and lighting effects together with the structure itself.

US 2007/0263379 describes a LED lighting apparatus consisting of a hollow section to be encompassed within an architectural surface.

US 2005/0180135 describes a lighting apparatus for creating a substantially continuous slot, comprising an elongated envelope, a LED strip mounted in said envelope, and a reflector, which reflects the light generated by the LEDs onto a translucent band forming part of said envelope.

It is the object of the invention to provide a furnishing structure with a linear extension which is suitable for generating a continuous light strip, starting essentially along the structure itself.

It is another object of the invention to provide a furnishing structure which is adapted to be integrated within building backgrounds of the most varied nature, and which is made of masonry work, plasterboard, wood, etc.

It is another object of the invention to provide a furnishing structure which allows a significantly diffused light strip to be obtained even though it uses point light sources.

It is another object of the invention to provide a furnishing structure in which the light sources are easy to be replaced in case of failures.

It is another object of the invention to provide a furnishing structure which can be encompassed within building structures of various shapes, and in particular within flat structures and right-angle, concave or convex structures.

It is another object of the invention to provide an alternative furnishing structure to traditional furnishing structures provided with light sources.

All these objects and others which will become apparent from the description below are achieved in accordance with the invention, by a furnishing structure as defined in claim 1.

Figure 2:
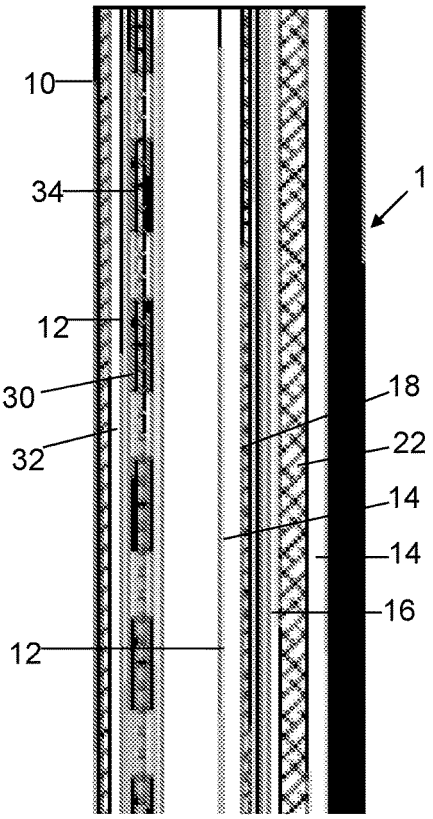
Figure 3:
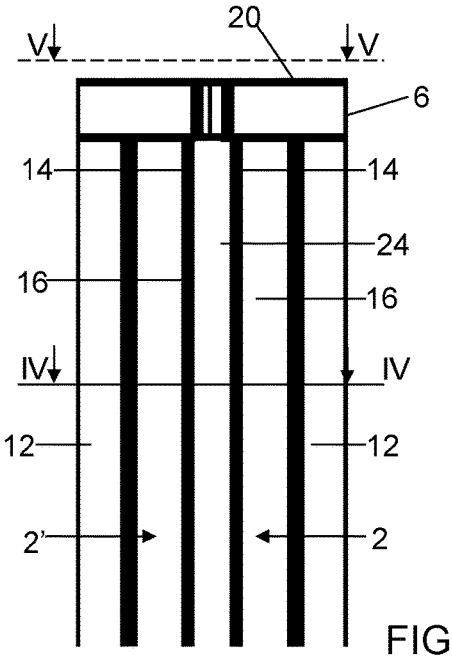
Figure 4:
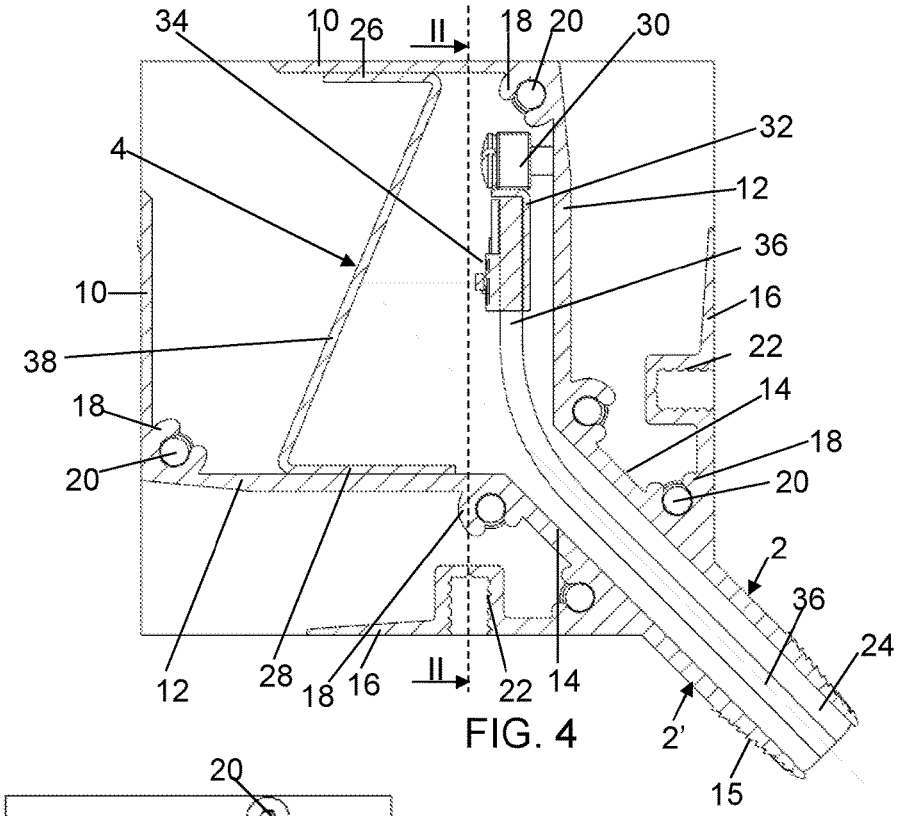
Figure 5:
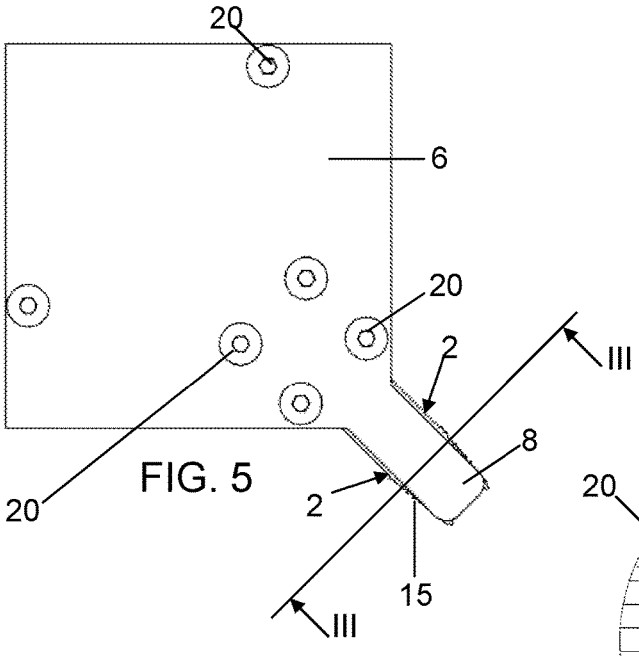
Figure 6:
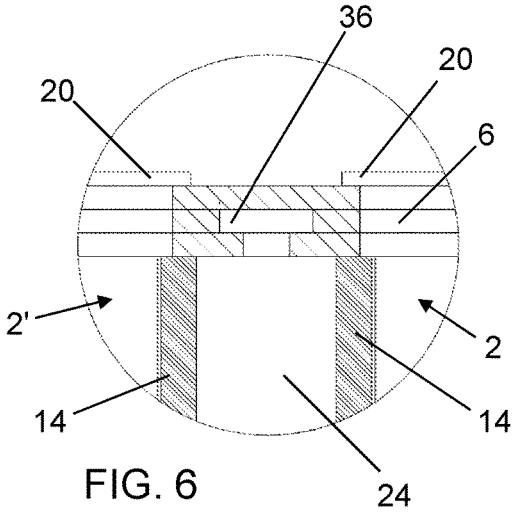
Figure 11:
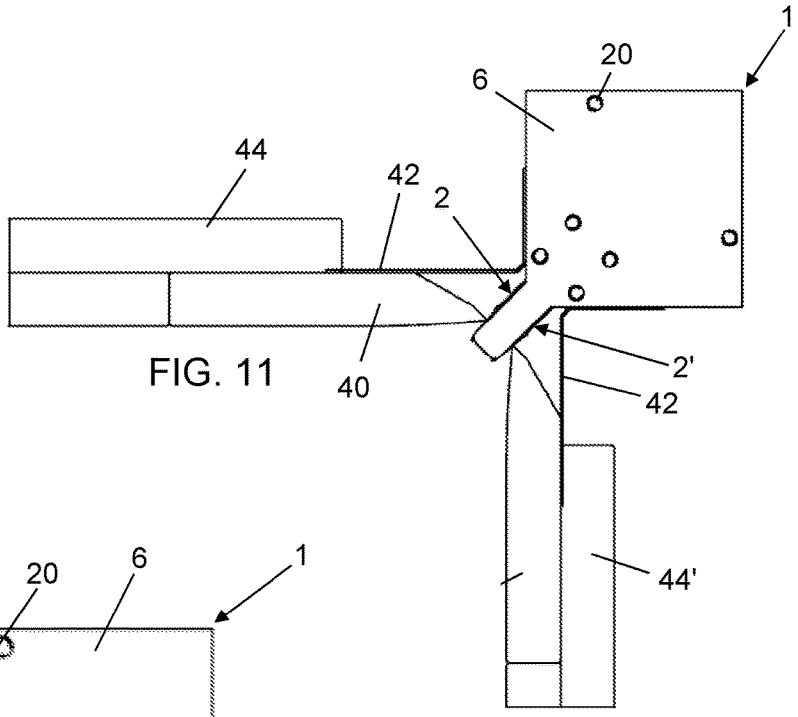
Figure 12:
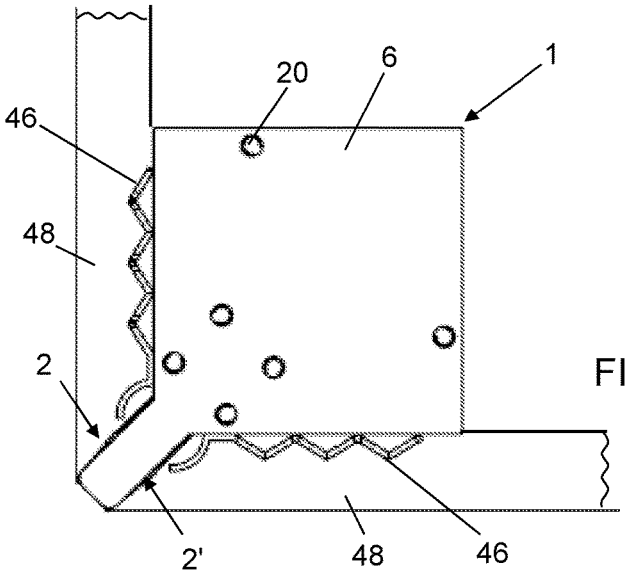
Figure 13:
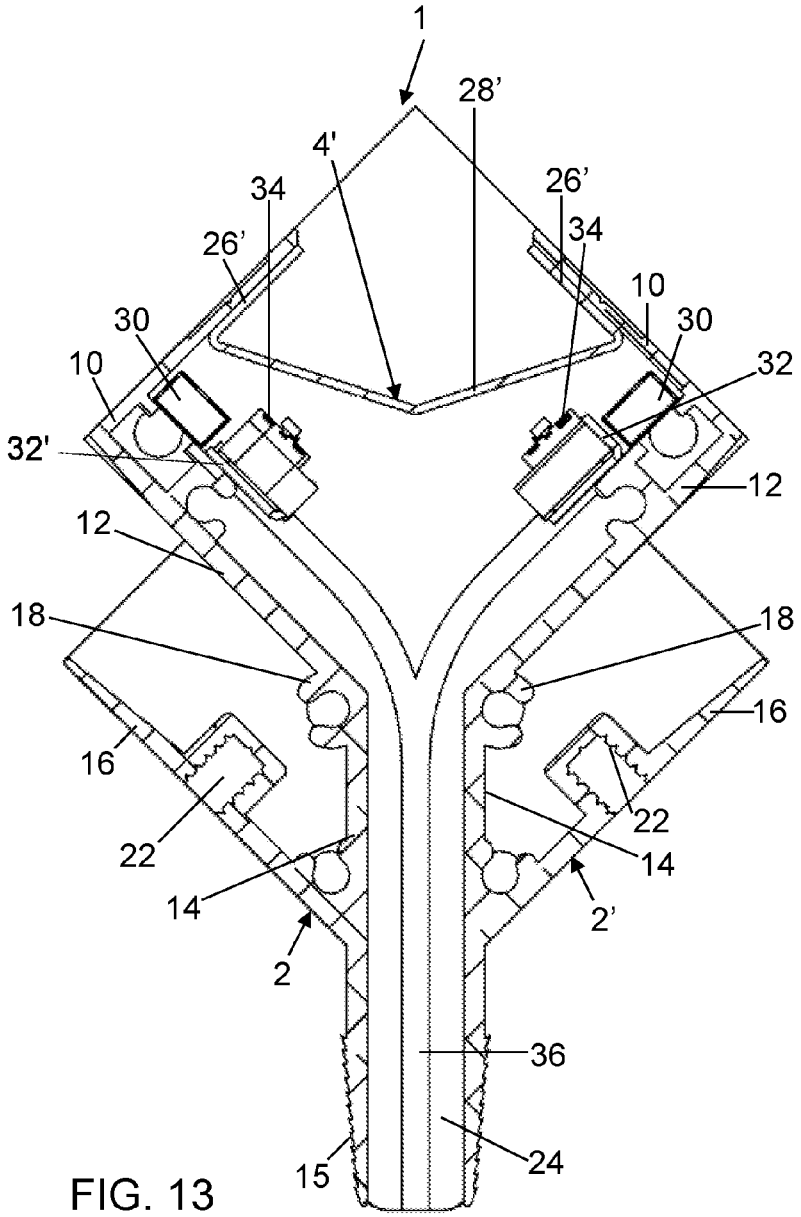

The present invention is hereinbelow further clarified in certain preferred embodiments thereof and in certain applications of the embodiments, which are described by mere way of non-limiting example, with reference to the accompanying drawings, in which:

FIG. 1 shows a partly interrupted perspective view of a furnishing structure in accordance with the invention, FIG. 2 shows it in accordance with the longitudinal section according to the line II-II in FIG. 4, FIG. 3 shows it in accordance with the longitudinal section according to the line III-III in FIG. 5, FIG. 4 shows it in accordance with the cross section according to the line IV-IV in FIG. 3, FIG. 5 shows a plan view thereof according to the line V-V in FIG. 3, FIG. 6 shows an enlarged detail of FIG. 3, FIGS. 7 to 12 show (in the same view as in FIG. 5) some examples of integrating the furnishing structure in accordance with the invention within different building backgrounds, and FIG. 13 shows (in the same view as in FIG. 4) the furnishing structure in accordance with the invention, in a different embodiment.

As seen in the drawings, the furnishing structure 1 in accordance with the invention essentially comprises two base sections 2, 2' of approximately Z-shaped identical section, and the length thereof can be defined according to the length of a light strip to be obtained. They are held together over the whole extension thereof by a third section 4, which is essentially Z-shaped and is intended to perform several functions which are better clarified below. Moreover, the two sections 2, 2' are also held together at both ends by two heads 6 having a significantly square plan, with a leg 8 extending outward from one corner in the direction of the corresponding diagonal.

Each base section 2, 2' comprises a first end wing 10 which extends into a second median wing 12, which is arranged substantially at 90° with respect to the preceding one, and a third end wing 14, which is arranged at about 135° with respect to the second one and extending past the volume defined by the end head 6 over the whole extension of the leg 8 thereof. The outer end band of this third wing 14 has a knurling 15 intended to promote the application of a finishing building panel to the third wing 14, as will be better seen below.

Then, a fourth wing 16 starts from the third end wing 14 of each base section 2, 2', parallel to the second median wing 12, the fourth wing being also substantially parallel to the first end wing 10 of the other base section 2, 2', and extends into the volume of the end heads 6.

The sections 2, 2' have tubular seats 18 at the joining corners between the different wings 10, 12, 14 and 16 for the engagement of screws 20 for fastening the heads 6 to the sections themselves.

Moreover, the fourth wing 16 of each of the two base sections 2, 2' has a continuous groove 22 with knurled walls intended to house screws or similar means for fastening an outer wood or plasterboard panel to the respective section 2, 2' or a grille for gripping a plaster layer or the like, as will be better seen below.

As said, the two base sections 2, 2' are constrained in the reciprocal position thereof by the third connection section 4 and by the two end heads 6.

More specifically, the two base sections 2, 2' are mutually stabilized so that the two first end wings 10 thereof are mutually arranged at 90° along the sides of the two end heads 6, and so that the third end wings 14 thereof are arranged parallel to each other at a reciprocal distance such as to delimit a slot 24 which substantially corresponds to the width of the light strip to be obtained.

In this reciprocal position, the connection section 4 is joined, with a first end wing 26 thereof, to the first end wing 10 of the base section 2, and with a second end wing thereof 28, to the second median wing 12 of the other base section 2'.

The constraint between the corresponding wings of the two base sections 2, 2' and of the connection section 4 may take place with any traditional technique, and more specifically by welding or gluing or by means of screws or rivets.

A plurality of magnets 30 is applied to the median wing 12 of section 2 with traditional techniques and at preferably constant distances, the magnets cooperating with a ferromagnetic section 32, to which a LED strip 34 is applied.

The assembly formed by the ferromagnetic section 32 and the LED strip 34 is provided at both ends with two small slides (not depicted in the drawings), preferably made of Teflon, which cooperate with guides 36 obtained in the two heads 6 and starting from the magnets 3, from the opening toward the exterior of slot 24.

The intermediate wing 38 of the connection section 4 forms, with the two end wings 26 and 28 of the connection section itself, acute angles such that when section 4 is fastened to the two base sections 2, 2', the intermediate wing 38 forms, with the longitudinal median plane of slot 24, an angle which is substantially equal to the angle formed by the intermediate wing 38 itself with the plane passing through the LED strip 34. Thereby, the light rays which are emitted by the LED strip 34 and which hit the intermediate wing 38, are mainly directed toward slot 24 and are simultaneously subjected to a partial diffusion due to an imperfect mirroring of the wing surface, which diffusion causes a substantial uniformity of the light passing through the slot itself.

The furnishing structure 1 in accordance with the invention is adapted to be integrated within a building background in general, so as to generate a light strip which is delimited by two walls angled to each other at 90° or mutually coplanar, however made and however arranged.

Figure 7:
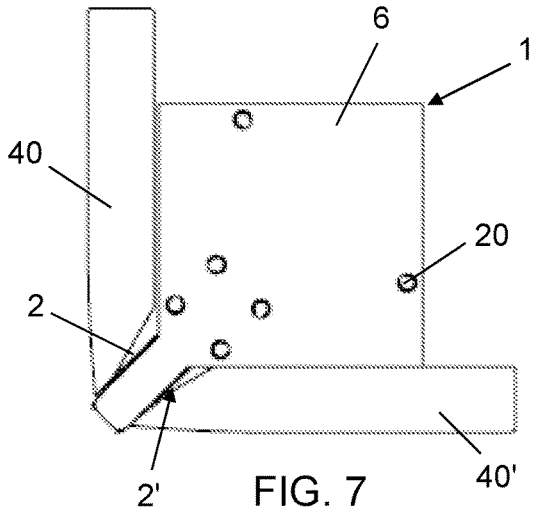

For example, FIG. 7 diagrammatically shows a structure 1 in accordance with the invention, interposed between two vertical plasterboard panels 40, 40', which are applied in a traditional manner to the two fourth wings 16 of the two sections 2, 2' with screws applied at the grooves 22 so that slot 24 defined at the outer corner delimited by the two plasterboard panels 40, 40' generates a light strip.

Figure 8:
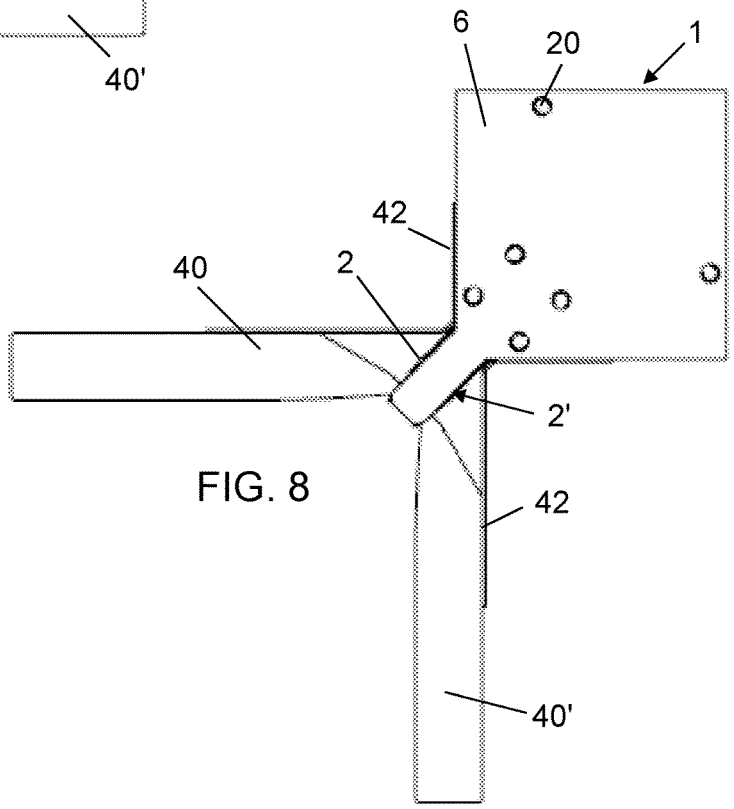

FIG. 8 instead shows the same furnishing structure 1 in accordance with the invention, integrated within a building background formed again by two plasterboard panels 40, 40', which are further applied to the furnishing structure by means of two L-shaped additional sections 42 constrained, with one wing, to one of the two sections 2, 2' of the structure itself and, with the other wing, to the plasterboard panel 40, 40'.

Figure 9:
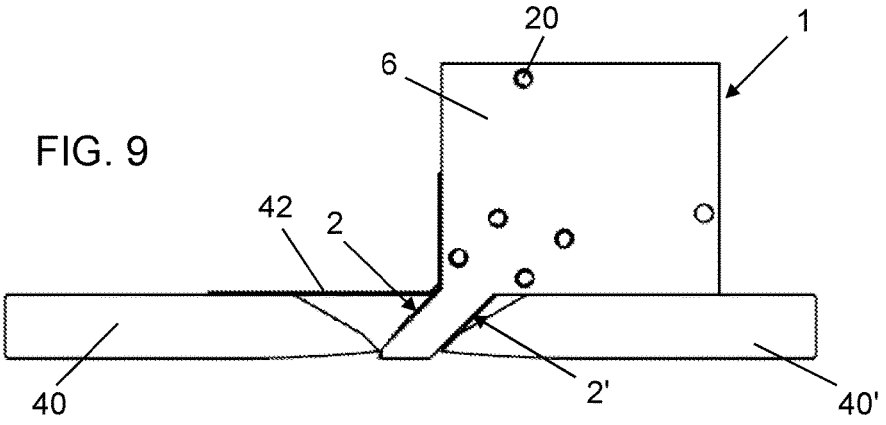

The furnishing structure in accordance with the invention in FIG. 9 is used to create a light strip between two coplanar plasterboard panels 40, 40', one constrained directly to a section 2' of the structure in accordance with the invention, the other constrained to the other section 2 by means of an additional L-shaped section 42. These two coplanar panels 40, 40' may be arranged vertically so as to form a vertical wall having a vertical or horizontal light strip, depending on the arrangement of the structure in accordance with the invention, or they may be arranged horizontally to form a suspended ceiling, which also has a light strip.

Figure 10:
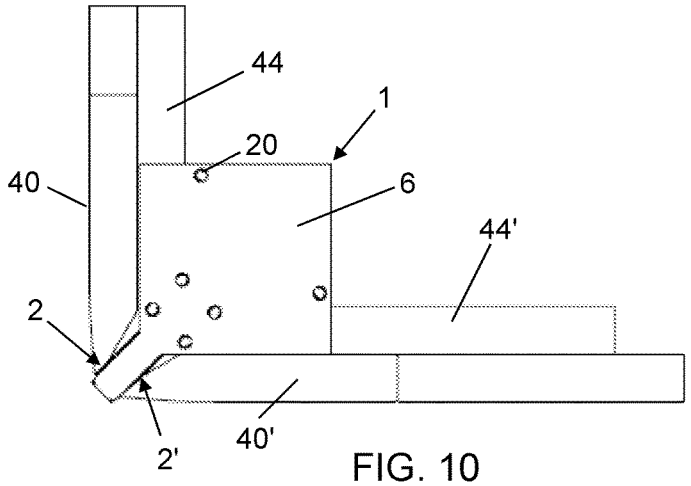

The furnishing structure 1 in accordance with the invention in FIG. 10 is integrated within a building background similar to that shown in FIG. 7 but formed by double plasterboard panels each comprising an outer panel 40, 40' constrained to a section 2, 2' in the form seen above, and an inner one 44, 44' constrained to the same section 2, 2' by inserting it between the second median wing 12 thereof and the fourth wing 16 thereof. Obviously, the two paired panels may then be fastened to each other in a traditional manner.

The furnishing structure 1 in accordance with the invention in FIG. 11 is integrated within a building background similar to that shown in FIG. 8 but formed by two double plasterboard panels each comprising an outer panel 40, 40' applied to the furnishing structure by means of two additional sections 42 and an inner one 44, 44' fastened to the same additional sections 42 and to the corresponding outer panel 40, 40'.

FIG. 12 shows a furnishing structure in accordance with the invention, in which a grille 46 for gripping a plaster layer 48 is applied to the outer surface of the two sections 2, 2'.

Obviously, there are provided different uses from those described here but obtained with the most varied combinations thereof.

If the LED strip 34 is to be replaced with another one, the operation is possible without disassembling or damaging the furnishing structure.

The operation includes engaging the two slides arranged at the two ends of the LED strip 34 with simple hooks introduced through slot 24, and exerting a sufficient traction on the ends so as to detach the ferromagnetic section 32 from the magnets 30. Then, the two slides are caused to slide along the respective guides 36 on the two heads 6, up to extracting the LED strip 34 through slot 24.

Then, once the LED strip 34 has been replaced and the electrical connections have been restored, the new strip may be reintroduced into the structure, in the place of the previous one, with maneuvers in reverse order to those performed for the removal thereof.

The embodiment shown in FIG. 13 differs from the preceding embodiment in that it has a different section 4' for connecting the two sections 2, 2', which are both provided with magnets 30 for constraining two LED strips 34 by means of ferromagnetic sections 32. The connection section 4' comprises two end wings 26' fastened to the first wing 10 of the two base sections 2, 2' and two inner wings 28' angled to each other so as to reflect the light rays from the two LED strips 34 constrained to the two base sections 2, 2', along said slot 24. Here, the guides 36 obtained in the two base heads 6 have a typical forked orientation for guiding the slides 32' provided at the ends of each LED strip 34 toward the respective magnets 30 applied to one or the other section 2, 2'. In one variant of this embodiment (not depicted here), the two sections 2, 2' are also intended to define two slots therebetween, each being capable of creating a light strip generated by one of the two LED strips 34. Here, each base head 6 has two separate guides 36 for the slides 32' of the two LED strips 34.

In any case, irrespective of the embodiment of the structure in accordance with the invention, it has several advantages, and more specifically:

- it allows rectilinear light strips with a highly pleasant appearance to be created,
- it allows light strips of diffused light to be created without simultaneously making the LEDs visible and therefore with a diffused light effect and with a pleasant impact,
- it has increased flexibility in that it allows horizontal or vertical light strips to be obtained on walls or suspended ceilings, on inner corners or on outer corners, on structures made of plasterboard, wood, masonry, etc.
- the replacement of the light sources becomes possible without disassembling or damaging the structure,
- it is simple, and therefore cost-efficient, to be manufactured.

The present invention was disclosed and described in certain preferred embodiments thereof, but it is understood that manufacturing variants may practically be made thereto without departing from the scope of protection of the present patent for industrial invention. In particular, the examples disclosed define a prismatic-shaped furnishing structure with a square base so that the building panels mutually form 90° or 180° angles depending on whether or not the additional sections 42 are used. Moreover, the invention includes prismatic furnishing structures with a different shape, and therefore with building panels arranged according to different angles from one another, to be provided with a different conformation of the sections 2, 2'.

The invention claimed is:

1. A furnishing structure with light sources comprising:

two substantially equal base sections facing each other and each having a first end wing extending into a second median wing arranged at a first angle with respect to the first wing, and a third end wing extending from the second wing at a second angle, the two substantially equal base sections being held together by a connection section and by a pair of end heads so as to jointly define a prismatic body and to jointly delimit at least one slot for light rays to pass, said light rays being emitted by one or more light sources positioned removably inside a space delimited by said base sections facing each other and being reflected by said connection section, wherein the first wing is coplanar to a first wall of said prismatic body, and the third wing is adjacent to said second wing and extends parallel to the third wing of the other base section to delimit said slot when the two sections are facing each other.

2. The furnishing structure according to claim 1, wherein said base sections are provided with means for constraining components of a building background, in which said structure is intended to be incorporated so as to make said slot visible outside.

3. The furnishing structure according to claim 1, wherein said base sections define, with each other and with said end heads, the prismatic body extending to form a longitudinal leg delimiting said slot.

4. The furnishing structure according to claim 3, wherein each base section comprises a fourth wing, which starts from said third wing and is coplanar to a second wall of said prismatic body, adjacent to said first wall.

5. The furnishing structure according to claim 1, wherein each base section has a plurality of tubular seats for applying screws for fastening said end heads.

6. The furnishing structure according to claim 4, wherein the fourth wing of each base section has at least one longitudinal groove with knurled walls, facing outward and adapted to be engaged by constraining means of an outer panel in a building background or of a grille adapted for gripping a plaster layer.

7. The furnishing structure according to claim 1, wherein at least one of the two base sections is provided with a plurality of magnets for removably constraining a ferromagnetic section, which is integral with an LED strip forming said one or more light sources.

8. The furnishing structure according to claim 7, wherein slides are associated at both ends of said ferromagnetic section, the slides being engaged in guides obtained in said end heads and starting from said magnets at an outer end of said slot.

9. The furnishing structure according to claim 8, wherein said connection section is essentially Z-shaped, with an end wing fastened to the first wing of a first base section, with another end wing fastened to the second wing of a second base section, and with an intermediate wing angled so as to reflect the light rays diffused from said one or more light sources applied to one of said base sections along said slot.

10. The furnishing structure according to claim 8, wherein said connection section comprises two end wings fastened to the first wing of both of said base sections and two inner wings angled so as to reflect the light rays from two light sources applied to both said base sections along said slot.

11. The furnishing structure according to claim 10, wherein each end head has a guide, which starts from the outer end of said slot and then separates into two branches, which join close to the magnets applied to the two base sections.

12. The furnishing structure according to claim 4, further comprising additional sections which are essentially L-shaped and have one wing to be constrained to the fourth wing of one of the base sections) and another wing constrainable to an outer wall of a building.

13. The furnishing structure according to claim 1, wherein an outer surface of said third wing of each base section at least partially has a longitudinal knurled band.

* * * * *